United States Patent [19]

Pepper

[11] 3,944,770

[45] Mar. 16, 1976

[54] SWITCH ASSEMBLY

[75] Inventor: Kenneth V. Pepper, Davison, Mich.

[73] Assignee: Genova, Inc., Davison, Mich.

[22] Filed: Aug. 19, 1974

[21] Appl. No.: 498,599

[52] U.S. Cl. ..... 200/84 R
[51] Int. Cl.[2] ..... H01H 35/18
[58] Field of Search ..... 200/84 R, 84 B, 61.52; 73/308, 313; 340/244 B

[56] References Cited

UNITED STATES PATENTS

| | | | |
|---|---|---|---|
| 3,071,663 | 1/1963 | Fritz | 200/61.52 |
| 3,483,341 | 12/1969 | Reichensperger | 200/84 R |
| 3,746,035 | 7/1973 | Singer | 200/84 R |

*Primary Examiner*—David Smith, Jr.
*Attorney, Agent, or Firm*—Olsen and Stephenson

[57] ABSTRACT

Apparatus for use with a sump pump that includes a submersible switch assembly for starting and stopping the pump automatically for removal of water from the sump. The submersible switch assembly includes a pivotally mounted float which contains a microswitch for starting and stopping operation of the pump according to the level of water in the sump. The float contains a raceway in which a gravity actuated roller element is located, and the trip arm of the microswitch extends into the raceway and is activated by movement of the roller element. The construction and arrangement of the trip arm and the raceway eliminates any likelihood that undesired hunting of the switch assembly will occur.

6 Claims, 4 Drawing Figures

SWITCH ASSEMBLY

BACKGROUND OF THE INVENTION.

The present invention relates to submersible switch assemblies for actuating sump pumps or similar pumps which are used to remove accumulated liquid from a sump or other chamber whenever the liquid reaches a preselected level.

It is known in the art to provide float-actuated switches for starting and stopping pumps used for removal of the liquid in tanks in which the floats are located. Generally, these float-actuated switches are responsive to movement to cause a ball or a globule of mercury to close or open contacts of the switch for starting and stopping the pump. Float-actuated switches of the type found in the prior art are not fully adequate to meet the needs of the plumbing industry for use with sump pumps either from cost or performance considerations. In particular, the prior art fails to provide a submersible switch assembly which has a simple, low-cost construction that produces positive switching action without undesirable faults, such as hunting of the switch, and the like.

SUMMARY OF THE INVENTION.

The present invention has overcome the inadequacies of the prior art and provides a molded plastic float that is mounted for pivotal movement in response to the change of the level of water in a sump. The float includes a raceway of unique configuration in which a roller element can move in response to gravity. A microswitch is supported in the float adjacent to the raceway so that its trip arm can extend to a selected position in the raceway for actuation by the roller element. The trip arm has a configuration to conform with the unique configuration of the raceway, and the construction and arrangement of the trip arm and the raceway are such that only positive opening and closing of the microswitch can occur.

According to a preferred form of the present invention, a submersible switch assembly is provided which has a mounting bracket, and a hermatically sealed float pivotally mounted on the bracket for pivotal movement between an upper and a lower position. The float contains an electrical switch with a trip arm for closing and opening the switch. A raceway is within the float and extends generally in a radial direction relative to the axis of pivotal movement of the float and is located adjacent to the electrical switch so that the trip arm of the switch can extend into the raceway. The raceway has an intermediate portion and radially inner and outer end portions. The radially inner and outer end portions have positive slopes toward the intermediate portion at all times during pivotal movement of the float except when the float is pivoted essentially to its upper or lower positions, the radially inner end portion having a negative slope toward the intermediate portion only when the float is pivoted essentially to its lowermost position and the radially outer end portion having a negative slope toward the intermediate portion only when the float is pivoted essentially to its uppermost position. A roller element is located in the raceway and is movable in response to gravity the length of the raceway. The roller element is operable when the float is pivoted to its lower position to roll from the radially inner end of the raceway over the intermediate portion to the radially outer end and operable when the float is pivoted to its upper position to roll from the radially outer end over the intermediate portion to the radially inner end. The trip arm extends into the raceway so as to be actuated by the roller element during traverse of the raceway.

Preferably, the slopes of the radially inner and outer portions have an included angle of approximately 90° relative to one another so that the intermediate portion forms, in effect, an overcenter position, whereby when the roller element is caused to start rolling from one end to the other, it passes the overcenter position and it cannot then return thereby avoiding any likelihood of hunting of the switch assembly.

Thus, it is an object of the present invention to provide an improved submersible switch assembly which is characterized by its relative low cost and its desirable performance characteristics.

Other objects of this invention will appear in the following description and apppended claims, reference being had to the accompanying drawings forming a part of this specification wherein like reference characters designate corresponding parts in the several views.

DESCRIPTION OF THE PREFERRED EMBODIMENT.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Figure 1:
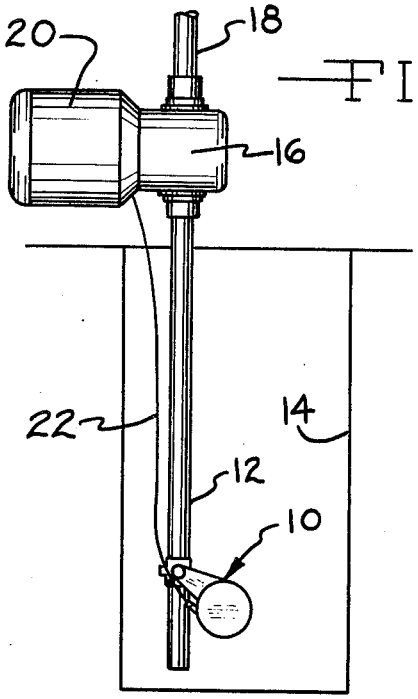
FIG. 1 is an elevational view of a sump and sump pump, and showing a submersible switch assembly embodying the present invention associated therewith.

Referring now to the drawings, the invention will be described in greater detail. As shown best in FIG. 1, the submersible switch assembly 10 is mounted on a conduit 12 which extends into the sump 14 and is connected to the suction side of the sump pump 16. The latter has its discharge side connected to the conduit 18 for discharging water removed from the sump 14. The sump pump 16 has an electrical motor 20 whose operation is controlled by the submersible switch assembly 10 through the electrical conductor 22.

The submersible switch assembly 10 includes the mounting bracket 24 which is fastened to the conduit 12 by the screws 26. The mounting bracket 24 includes the shaft portion 28 on which the float 30 is pivotally mounted. The float is retained on the shaft 28 by means of the locking pin 32 which includes resilient legs 34 which will snap over the internal shoulder of the shaft 28 to lock the float on the shaft while allowing pivotal movement relative thereto.

Figure 4:
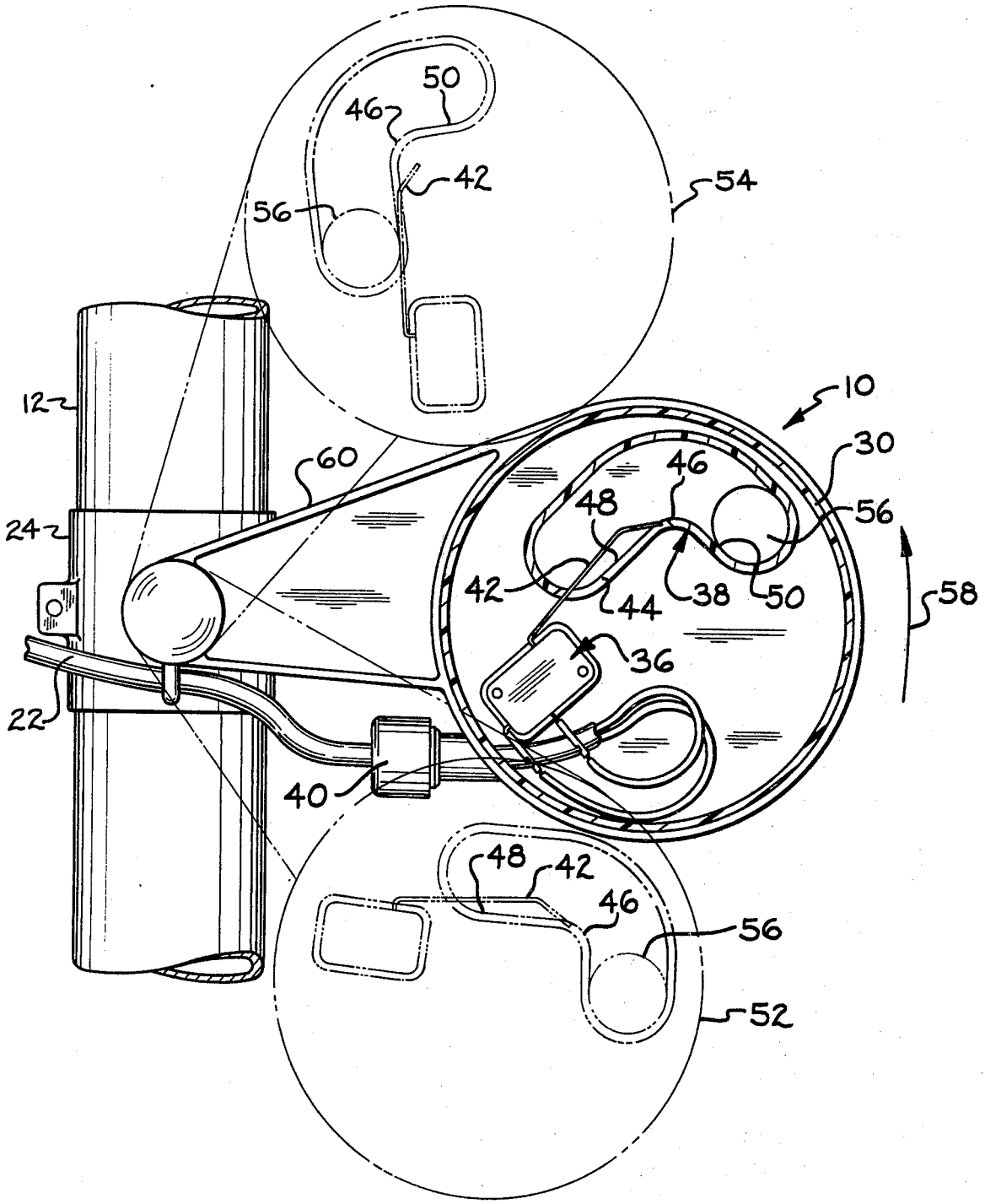
FIG. 4 is a fragmentary side elevational view showing in solid lines the float with its cover removed to illustrate the interior thereof, and showing in phantom lines the upper and lower positions of pivotal movement of the float of the switch assembly.

The float 30 has a hollow interior in which is mounted the microswitch 36 and in which is formed the raceway 38. As can be seen in FIG. 4, the microswitch 36 is electrically connected to the conductor 22 through an electrical fitting 40 that is impervious to water. The microswitch 36 has a trip arm 42 which extends through the slot 44 in the raceway 38.

Figure 2:
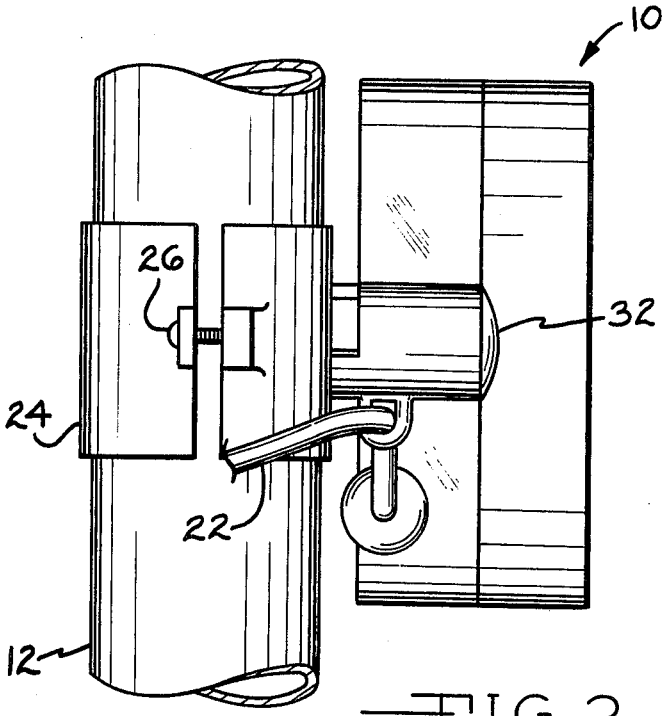
FIG. 2 is an enlarged end elevational view of the submersible switch assembly.
Figure 3:
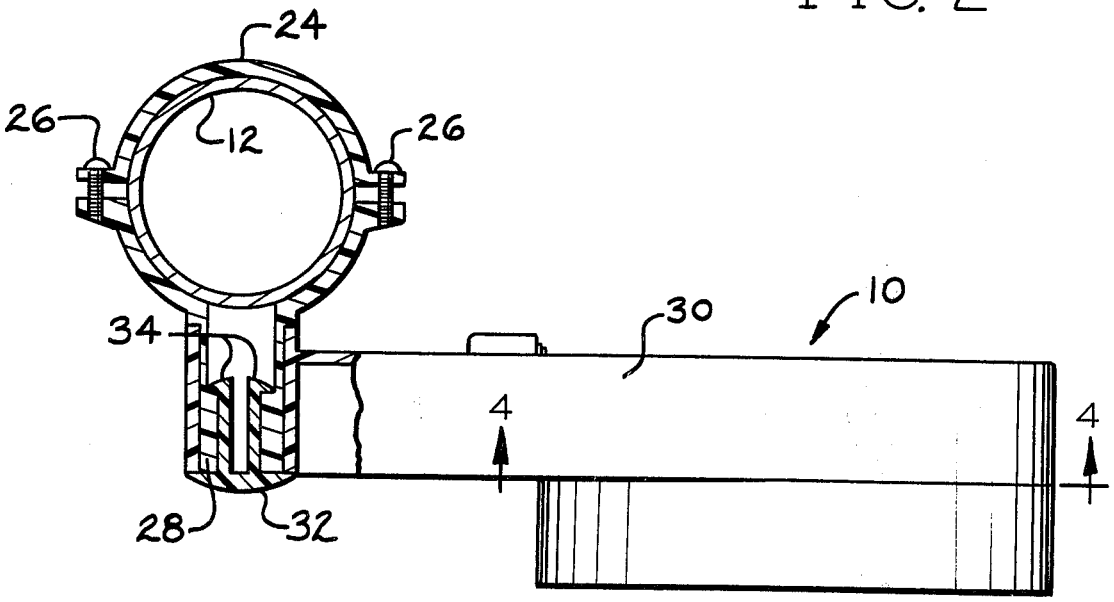
FIG. 3 is a top plan view of the submersible switch assembly showing in section portions of the mounting bracket.

The raceway 38 extends generally in a radial direction relative to the axis of pivotal movement of the float 30 and has an intermediate portion 46, a radially inner portion 48, and a radially outer portion 50. The radially inner and outer portions 48 and 50 have positive slopes with respect to the intermediate portion 46 during all movements of the float 30, except when the float 30 is at its lower position shown at 52 or when in its upper position shown at 54. When in the lower position shown at FIG. 2, the inner portion 48 will have a negative slope toward the intermediate portion 46, and when in its upper position the radially outer portion will have a negative slope toward the intermediate portion 46. Thus, the intermediate portion 46 will serve as an "overcenter" portion of the raceway to prevent return movement of a roller element once it has been discharged from either extreme end of the raceway by movement of the 30 either to its upper or lower extremity of movement.

Located within the raceway 38 is the ball or roller element 56 which is adapted to traverse the length of the raceway 38 in response to gravity when the float 30 has reached either its upper or its lower position. Thus when the roller element 56 is in the position shown at the lower position 52 of float 30, it will remain in the radially outer position, as shown, when the float 30 is caused to rise in the direction of arrow 58, and it will not move until the float 30 has essentially reached the upper position 54. The slope of the outer portion 50 has now become negative, and the roller element 56 will traverse the raceway to the radially inner position. When traversing the raceway, the roller element 56 will engage the terminal end of trip arm 42 to actuate the switch, closing the circuit to energize pump 16. When the pump has lowered the level of water in sump 14 so that the float reaches its lower position 52, the roller element will roll down radially inner portion 48, which has now assumed a negative slope, and will pass over intemediate portion 46 and return to the outer end of raceway 38 to the position of float 30 shown at 52. When the roller element 56 reaches the point of no return, the trip arm 42 will snap upward, giving the roller element a small, but helpful push to the outer end of raceway 38.

Thus, the switch assembly 10 provides a construction and arrangement which overcomes hunting problems, and it is also possible by suitable selection of the length of the arm of the float and the angle of the raceway to vary the levels between which the pump will be switch "on" and "off." For example, in a conventional domestic sump pump drainage system, it is common practice to use a differential of seven to nine inches; whereas, in an industrial application, a differential of 20 to 24 inches might be desirable. Whatever differential is desired can be obtained merely by the selection of a float arm 60 of a suitable length.

It is claimed:

1. A submersible switch assembly for starting and stopping a pump that is operable to remove liquid intermittently upon demand from a chamber comprising a mounting bracket, a hermetically sealed float pivotally mounted on said bracket for pivotal movement between an upper and a lower position, said float containing an electrical switch with a trip arm for closing and opening the switch, a raceway extending generally in a radial direction relative to the axis of pivotal movement of the float and located adjacent to said electrical switch and into which said trip arm extends, said raceway having an intermediate portion and radially inner and outer end portions, said radially inner and outer end portions having positive slopes toward said intermediate portion at all times during pivotal movement of said float except when said float is pivoted essentially to its upper or lower positions, the radially inner end portion having a negative slope toward the intermediate portion only when said float is pivoted essentially to its lowermost position and the radially outer end portion having a negative slope toward the intermediate portion only when said float is pivoted essentially to its uppermost position, and a roller element movable in response to gravity the length of said raceway, said roller element being operable when said float is pivoted to its lower position to roll from the radially inner end of said raceway over said intermediate portion to the radially outer end and operable when said float is pivoted to its upper position to roll from said radially outer end over said intermediate portion to said radially inner end, said trip arm extending into said raceway so as to be actuated by said roller element during traverse of said raceway, said trip arm entering said raceway at a location adjacent to the inner end of the radially inner end portion and extending to a location adjacent to said intermediate portion so that maximum mechanical advantage for closing said switch occurs when the roller element passes radially inwardly over the extended end of the trip arm.

2. The submersible switch assembly that is defined in claim 1, wherein the slopes of said radially inner and outer portions have an included angle of approximately ninety degrees relative to one another.

3. The submersible switch assembly that is defined in claim 1, wherein the extended arm of said trip arm terminates at the intermediate portion at a point of no-return for said roller element in its traverse of said raceway.

4. The submersible switch assembly that is defined in claim 3, wherein said raceway has a slot through which said trip arm extends, said slot extending to said intermediate portion, and the terminal end portion of said trip arm is inclined into said slot so that said roller element can roll onto said trip arm when moving from said outer end portion to said inner end portion.

5. The submersible switch assembly that is defined in claim 4, wherein said trip arm projects above the rolling surface of said raceway in said inner end portion so that the trip arm is depressed whenever said roller element is inward of said intermediate portion.

6. The submersible switch assembly that is defined in claim 1, wherein said switch is a microswitch.

* * * * *